US006397708B1

(12) United States Patent
Hung

(10) Patent No.: US 6,397,708 B1
(45) Date of Patent: Jun. 4, 2002

(54) SCREWDRIVER GRIP

(76) Inventor: Kun Chih Hung, No56, Shin Ren 3rd Street, Ta Li City, Taichung Hsien (TW)

( * ) Notice: Subject to any disclaimer, the term of this patent is extended or adjusted under 35 U.S.C. 154(b) by 0 days.

(21) Appl. No.: 09/605,030

(22) Filed: Jun. 28, 2000

Related U.S. Application Data

(63) Continuation-in-part of application No. 09/391,318, filed on Sep. 8, 1999.

(51) Int. Cl.[7] ..... B25B 23/16
(52) U.S. Cl. ..... 81/177.7; 81/177.8; 81/489
(58) Field of Search ..... 81/177.7, 177.1, 81/177.75, 177.85, 489, 177.8, 450

(56) References Cited

U.S. PATENT DOCUMENTS 1,840,685 A * 1/1932 Witherup ..... 81/177.1
4,170,909 A * 10/1979 Wagner ..... 81/63.2
4,825,734 A * 5/1989 Schwalbe et al. ..... 81/177.9
5,069,091 A * 12/1991 Bramsiepe et al. ..... 81/177.7
6,016,726 A * 1/2000 Wright ..... 81/177.7

* cited by examiner

*Primary Examiner*—Timothy V. Eley
*Assistant Examiner*—Dung Van Nguyen
(74) *Attorney, Agent, or Firm*—Rosenberg, Klein & Lee

(57) ABSTRACT

A screwdriver grip including a front section and a rear section pivotally connected with the front section. The outer edge of the pivot section is formed with more than one inward recessed engaging section. The center of the front end of the rear section is formed with a pivot cavity. Two sides of the pivot cavity are respectively disposed with two lugs. When the pivot section is pivotally connected with the pivot cavity, the lugs of the rear section clamp the pivot section of the front section. The rear section is disposed with a projecting engaging block corresponding to the engaging section of the front section. When the in rear section is moved forward, the rear sections is engaged with the front section and located without pivotally rotating. When the rear section is moved backward, the front section and the rear section can be pivotally rotated by a certain angle for a user to hold.

1 Claim, 11 Drawing Sheets

SCREWDRIVER GRIP

CROSS-REFERENCE TO RELATED APPLICATION

This application is a Continuation-In-Part application of Ser. No. 09/391,318, filed Sep. 8, 1999, and entitled "Screwdriver Grip".

BACKGROUND OF THE INVENTION

The present invention relates to a screwdriver grip the gripping angle of which is changeable to make the axis of the user's arm coincide with the rotational axis of the screwdriver. Therefore, the screwdriver can be conveniently operated without injuring the wrist of the user.

FIGS. 10 and 11 show a conventional wrench including a main body 9 having a hollow pivot section 91 for pivotally connecting with a grip 92. The grip 92 is formed with a slot 94 corresponding to the shaft 93 of the pivot section 91, whereby the grip 92 can be moved back and forth and pivotally rotated relative to the pivot section 91 of the main body 9. The outer edge of one side of the pivot section 91 is formed with multiple recesses 95. A lateral side of one end of the grip 92 is disposed with an engaging plate 96 corresponding to the recesses 95. The engaging plate 96 is inserted into any of the recesses 95, whereby the main body 9 and the grip 92 can be bent and located at different angles.

The structure between the grip 92 and the pivot section 91 of the main body 9 of the above wrench can be transferred and used in a screwdriver. However, the application force exerted onto the grip 92 and the reaction force exerted by the main body 9 will still concentrate on the engaging plate 96 where a shearing force is produced and may result in breakage of the engaging plate 96. The engaging plate 96 and the recesses 95 are respectively positioned on outer faces of the grip 92 and the pivot section 91 of the main body 9 without any support. Therefore, when the engaging plate 96 suffers the above shearing force, the engaging plate 96 will be outward pushed and bent. This will make the engaging plate 96 fail to effectively locate the main body 9 and the grip 92.

SUMMARY OF THE INVENTION

It is therefore a primary object of the present invention to provide a screwdriver grip having a front section and a rear section. The outer edge of the pivot section of the front section is formed with more than one engaging recess and the rear section is disposed with an engaging block corresponding to the engaging recess. When the pivot section is pivotally connected with the pivot cavity, the lugs of the rear section clamp two sides of the pivot section of the front section with the engaging block firmly engaged and located in the engaging recess and stably supported. When the rear section is moved forward, the rear sections is engaged with the front section and located without pivotally rotating. When the rear section is moved backward, the front section and the rear section can be pivotally rotated by a certain angle for a user to hold. The axis of the user's arm coincide with the rotational axis of the screwdriver so that the screwdriver can be conveniently operated without injuring the wrist of the user.

According to the above object, the screwdriver grip of the present invention includes a front section and a rear section. A front end of the front section is disposed with a tool section, while a rear end of the front section is formed with a pivot section. The pivot section is formed with a central slot. The outer edge of the pivot section is formed with more than one inward recessed engaging section. A front end of the rear section is formed with a pivot cavity. Two sides of the pivot cavity are respectively disposed with two lugs. Each lug is formed with a shaft hole. When the to pivot section is pivotally connected with the pivot cavity, a shaft rod is passed through the shaft holes and the slot with the lugs of the rear section clamping the pivot section of the front section. The rear section is disposed with a projecting engaging block corresponding to the engaging section of the front section.

The present invention can be best understood through the following description and accompanying drawings wherein:

DETAILED DESCRIPTION OF THE PREFERRED EMBODIMENTS

Figure 1:
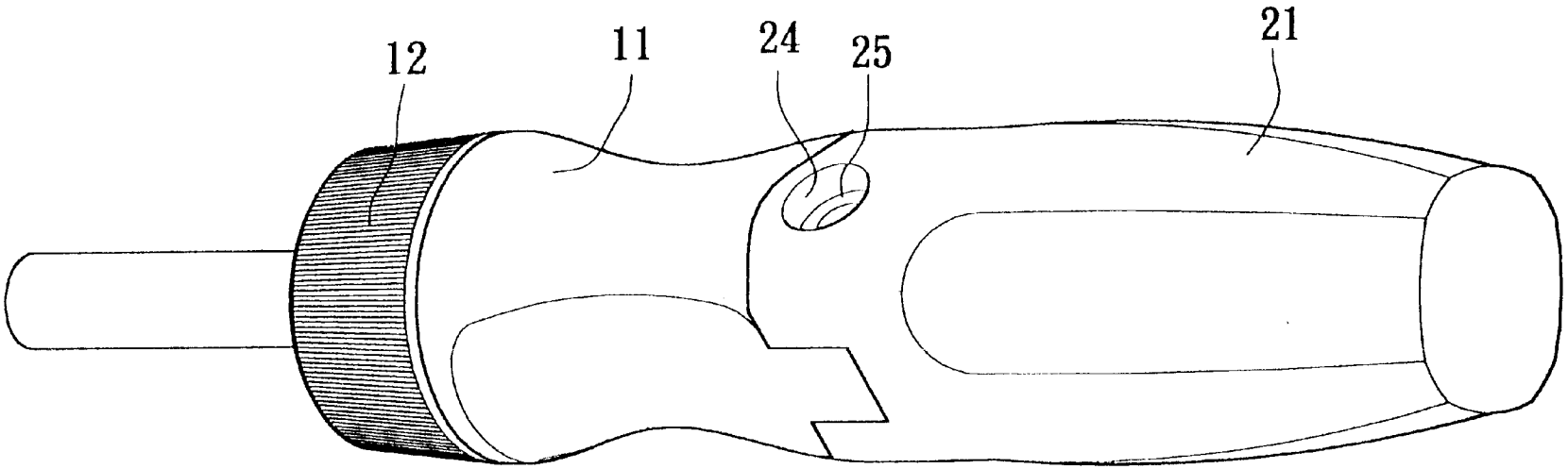
FIG. 1 is a perspective view of the present invention.
Figure 2:
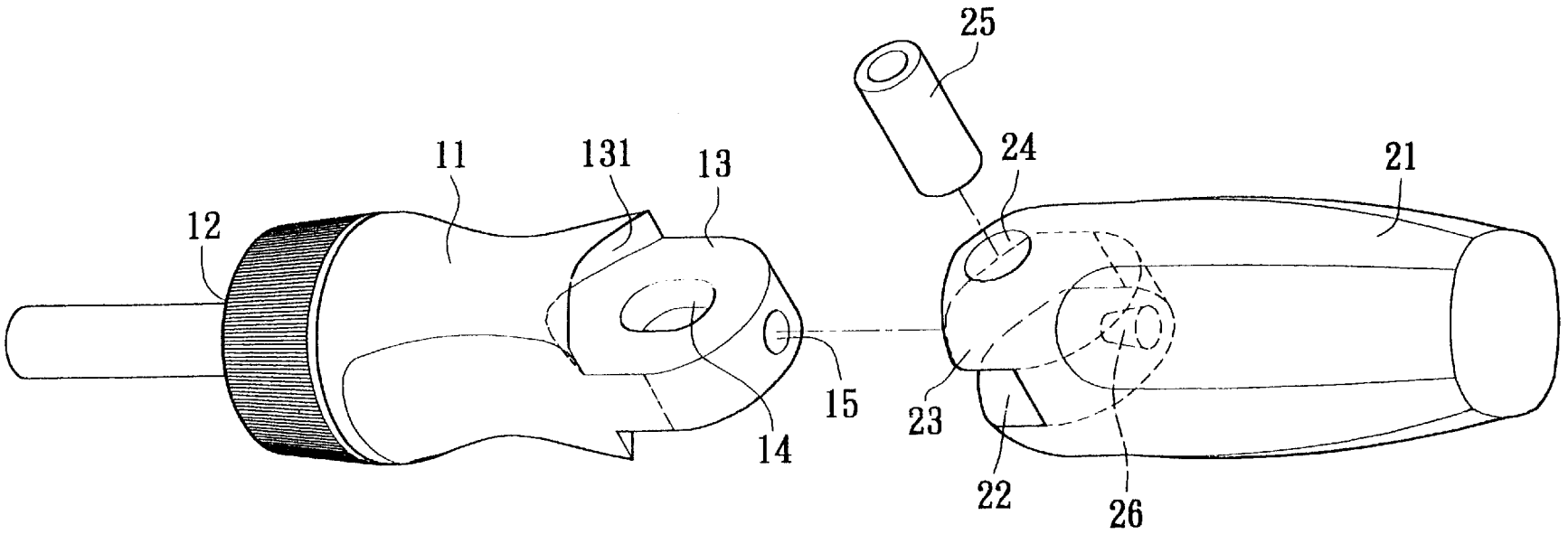
FIG. 2 is a perspective exploded view of the present invention.
Figure 3:
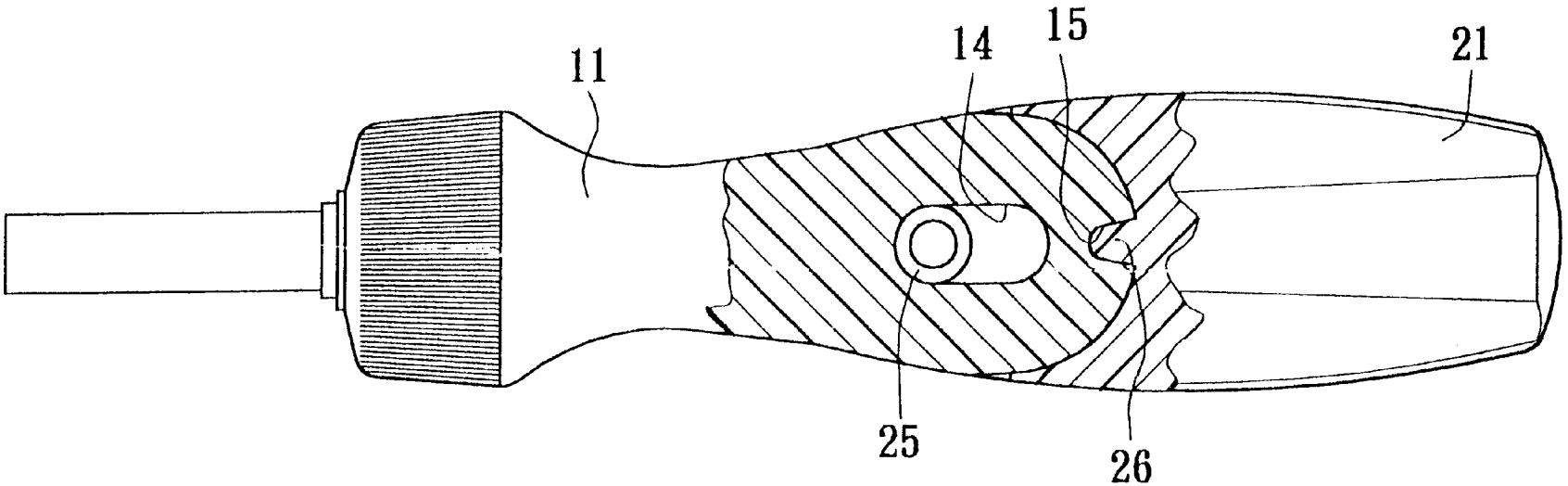
FIG. 3 is a partially sectional view of the present invention.

Please refer to FIGS. 1 to 3. The screwdriver grip of the present invention includes a grip composed of a front section 11 and a rear section 21. The front end of the front section 11 is disposed with a ratchet tool section 12, while the rear end thereof is formed with a pivot section 13. The pivot section 13 is formed with a central slot 14. The center of the rear edge of the pivot section 13 is formed with an engaging socket 15. The front end of the rear section 21 is formed with a pivot cavity 22. Two sides of the pivot cavity 22 are respectively disposed with two lugs 23. Each lug 23 is formed with a hole 24. When the pivot section 13 is pivotally connected with the pivot cavity 22, a shaft 25 is passed through the holes 24 and the slot 14 with the lugs 23 of the rear section 21 clamping two sides of the pivot section 13 of the front section 11. The pivot cavity 22 is disposed with a projecting post 26 corresponding to the engaging socket 15 of the pivot section 13. The front ends of two sides of the pivot section 13 are respectively formed with two insertion recesses 131 for the front ends of the lugs 23 of the pivot cavity 22 to insert thereinto.

Figure 4:
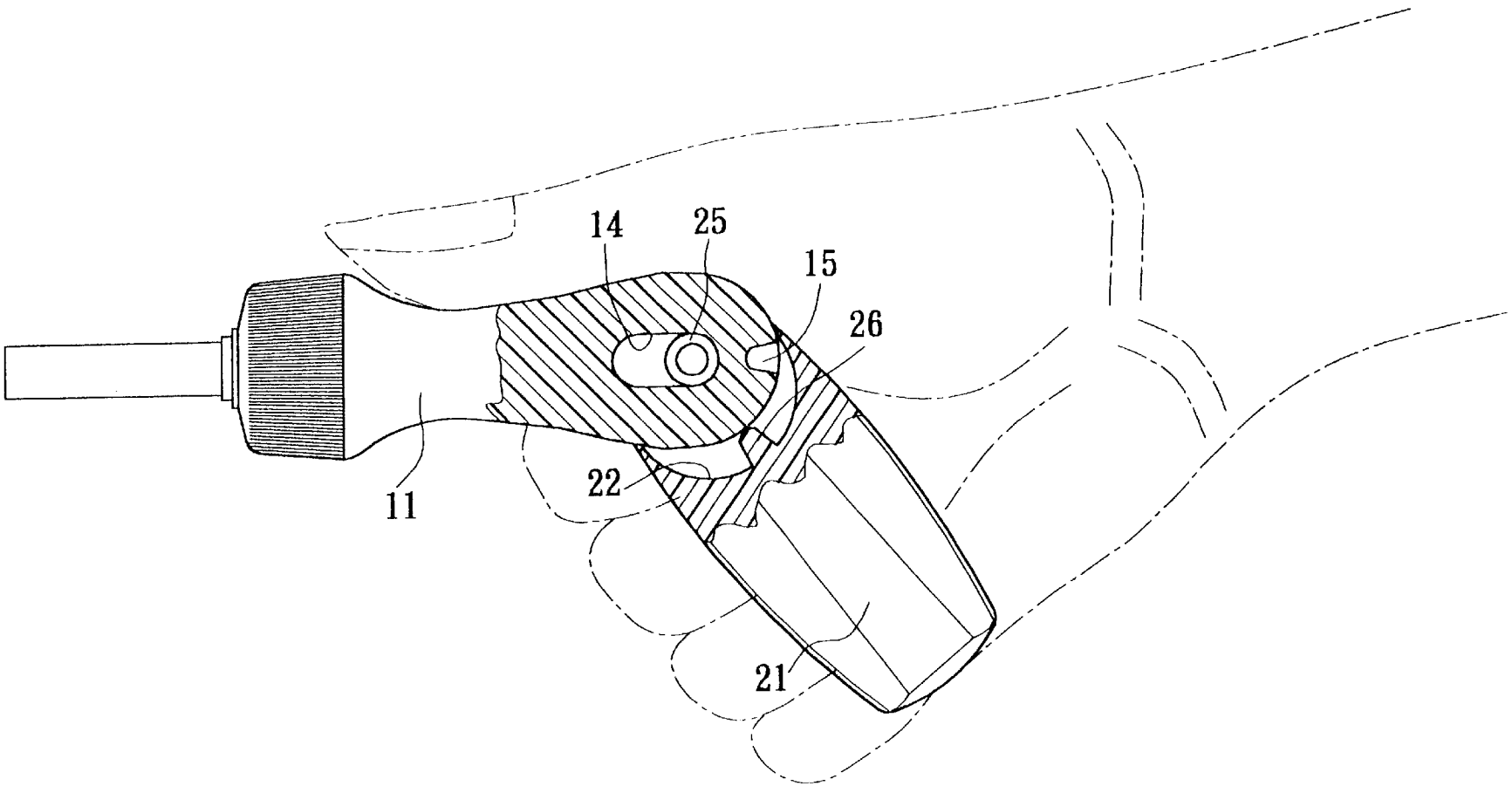
FIG. 4 shows the use of the present invention.
Figure 5:
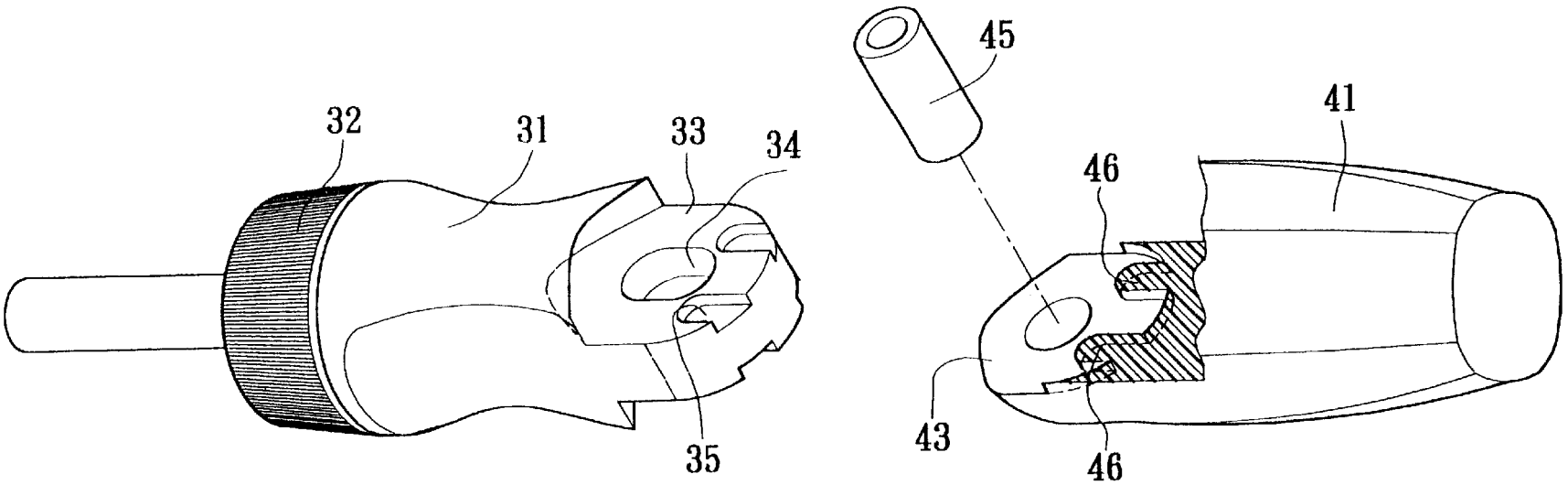
FIG. 5 is a perspective exploded view of a second embodiment of the present invention.
Figure 6:
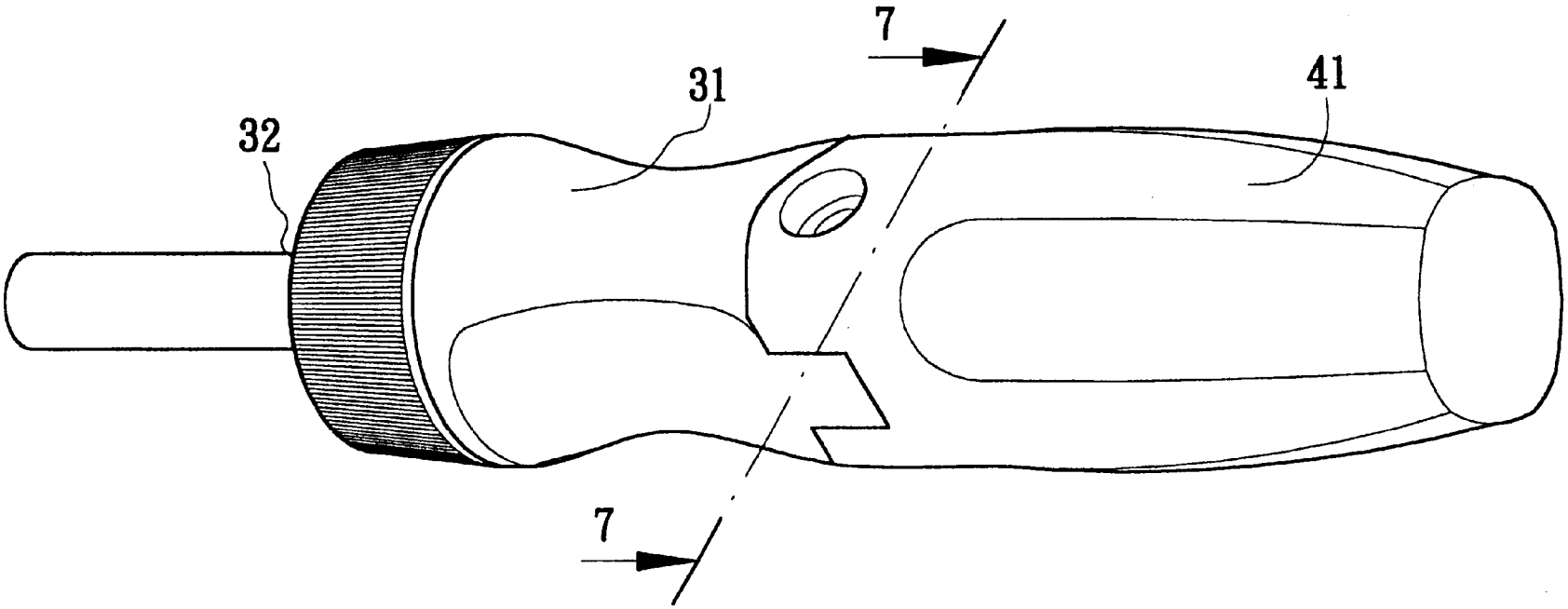
FIG. 6 is a perspective assembled view of the second embodiment of the present invention.
Figure 7:
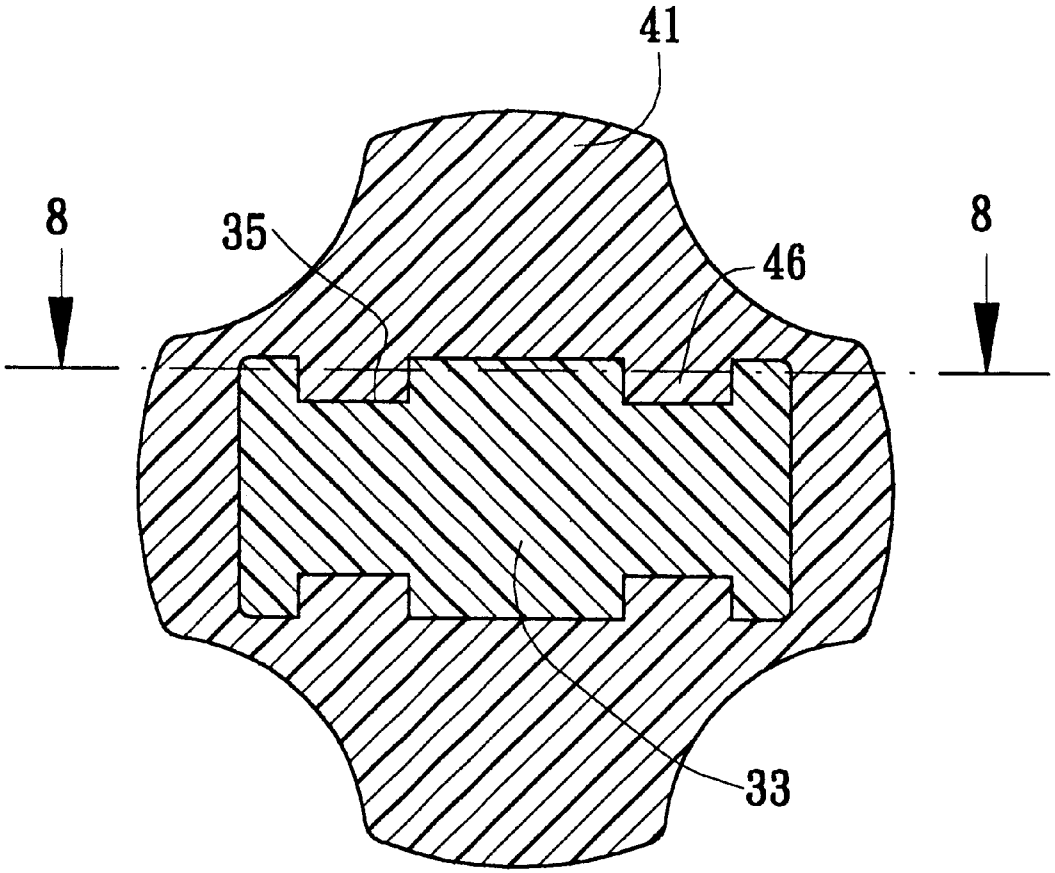
FIG. 7 is a sectional view taken along line A—A of FIG. 6.
Figure 8:
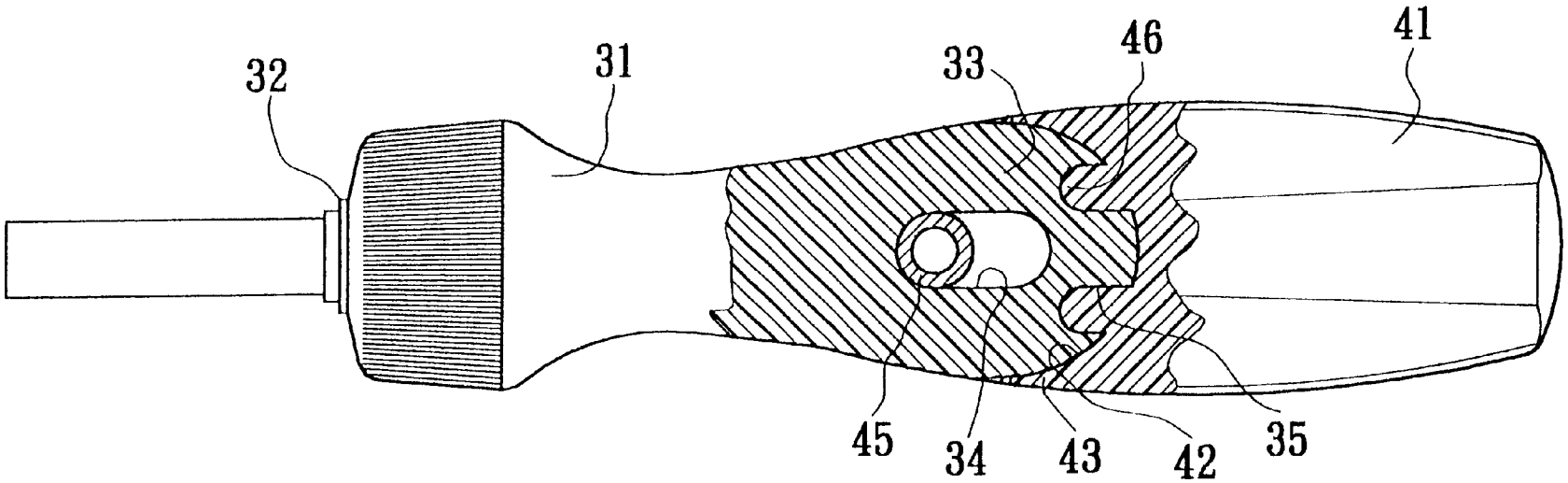
FIG. 8 is a sectional view taken along line B—B of FIG. 7.
Figure 9:
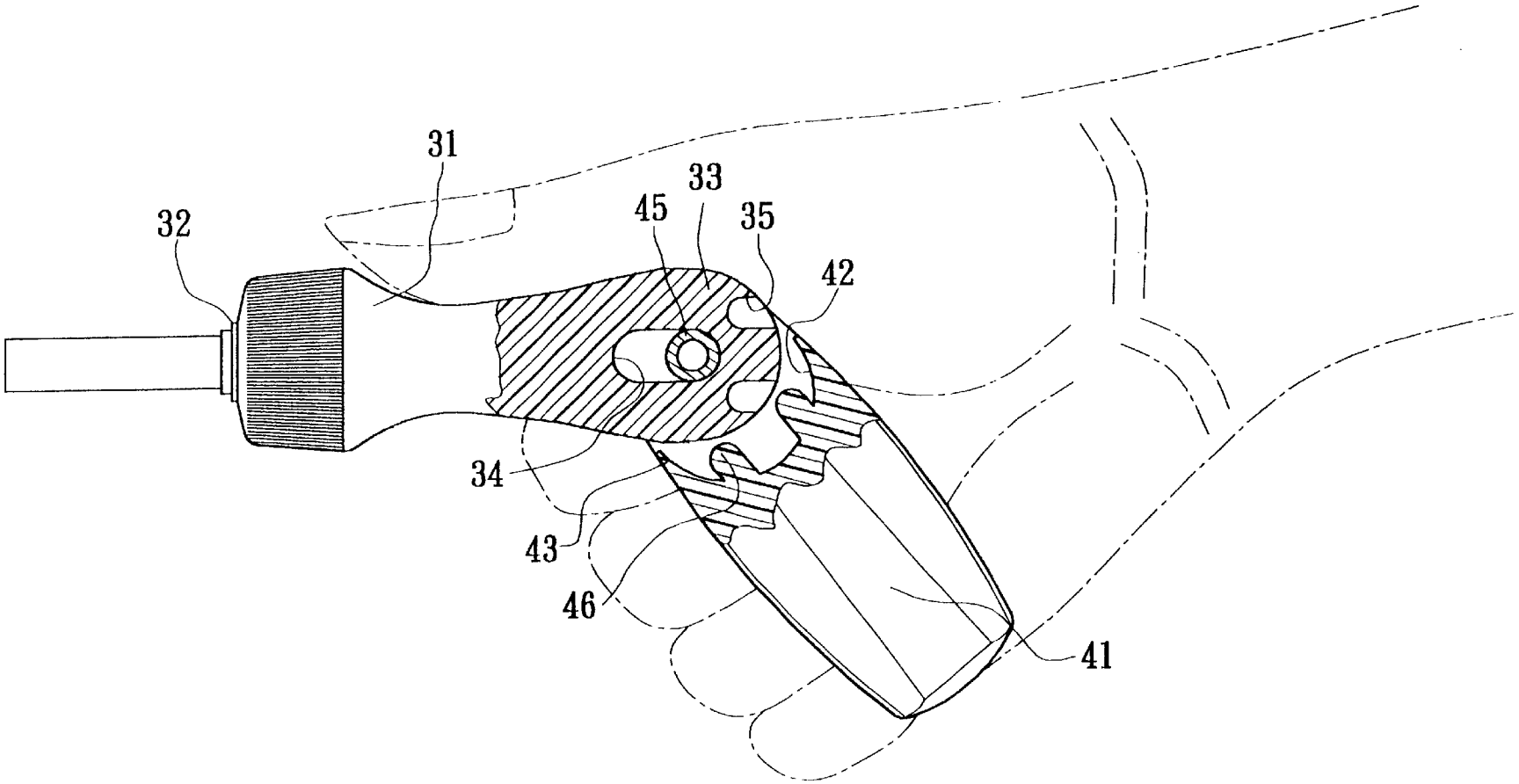
FIG. 9 shows the use of the second embodiment of the present invention.
Figure 10:
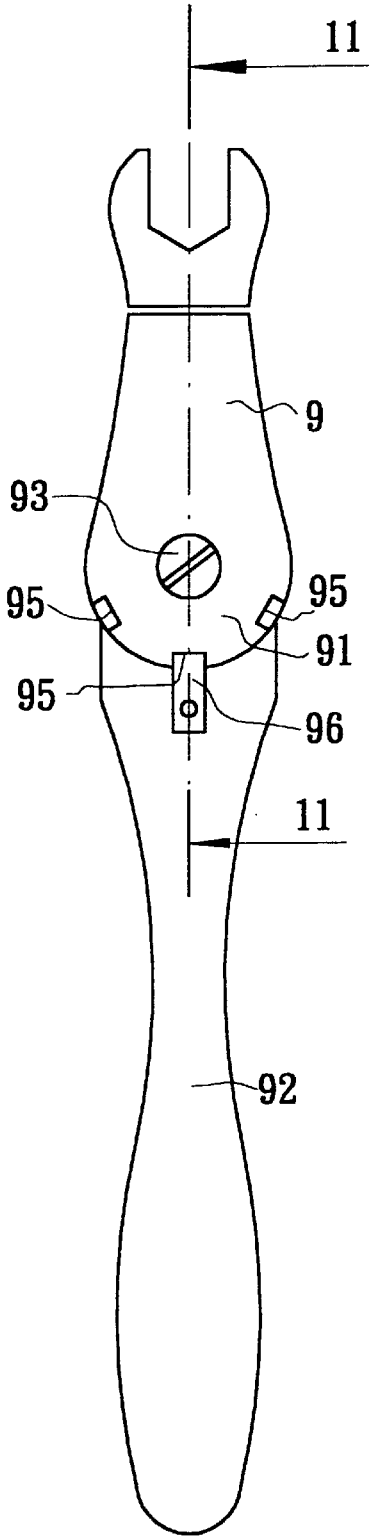
PRIOR ART FIG. 10
FIG. 10 is a plane view of a conventional wrench.
Figure 11:
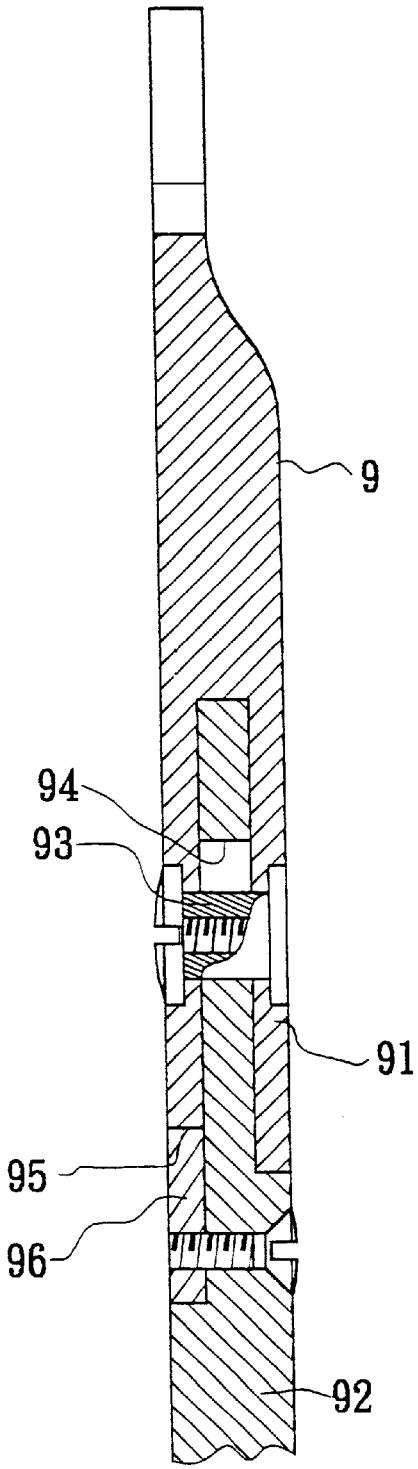
PRIOR ART FIG. 11
FIG. 11 is a sectional view taken along line C—C of FIG. 10.

Referring to FIG. 3, when it is desired to pivotally rotate the front section 11 relative to the rear section 21, the rear section 21 is first pulled backward. At this time, under the limitation of the slot 14 to shaft rod 25, the projecting post 26 is moved backward to disengage from the engaging socket 15. Under such circumstance, the front and rear sections 11, 21 can be pivotally rotated by a certain angle for a user to hold. Therefore, as shown in FIG. 4, the axis of the arm of the user can coincide with the rotational axis of the screwdriver without curving the wrist. Accordingly, even when quickly reciprocally rotate the screwdriver, the wrist will not get hurt. When restoring the grip to its home position, the front and rear sections 11, 21 are pivotally rotated to zero the angle contained therebetween. Then the rear section 21 is pushed forward. Under the limitation of the slot 14 to the shaft rod 25, the projecting post 26 is moved forward to engage into the engaging socket 15. In addition, the lugs 23 of the rear section 21 are inserted into the insertion recesses 131 of the front section 11 to firmly clamp the pivot section 13. Under such circumstance, the front and rear sections 11, 21 are firmly engaged and mated with each other and located. Accordingly, the pivot section 13 has no space for possible displacement or deformation so that the projecting post 26 is firmly engaged and located in the engaging socket 15 and the front and rear sections 11, 21 are coaxially fixed.

FIGS. 5 to 8 show a second embodiment of the present invention, in which the screwdriver grip includes a front section 31 and a rear section 41. The front end of the front section 31 is disposed with a ratchet tool section 32. The rear end of the front section 31 is disposed with a pivot section 33 having a central slot 34. Two sides of the pivot section 33 are respectively formed with multiple recesses 35 inward extending in a direction parallel to the extending direction of the slot 34. The front end of the rear section 41 is disposed with a pivot cavity 42 having two lugs 43 projecting from two sides of the pivot cavity 22. Each lug 43 is formed with a hole 44, whereby a shaft 45 is passed through the holes 44 and the slot 34 to pivotally connect the pivot section 33 and the pivot cavity 42. When the rear section 41 and the front section 31 are positioned on the same axis, the inner face of each lug 43 is formed with opposite projecting engaging blocks 46 corresponding to the recesses 35.

Both faces of the pivot section 33 of the front section 31 are formed with recesses 35. In addition, the projecting engaging blocks 46 formed on the inner face of each lug 43 of the rear section 41 extend opposite to each other. Therefore, the engaging block 46 is fully supported from front end to rear end. When all the engaging blocks 46 are inserted and engaged in the recesses 35, in use, the reaction force coming from the front section 31 is shared by the four supporting faces from front ends to rear ends of the engaging blocks 46. Moreover, the two lugs 43 of the rear section 41 clamp two lateral sides of the pivot section 31 so that the engaging blocks 46 will not be outward pushed away. Therefore, the engaging force of the engaging blocks 46 is enhanced and the engaging blocks 46 can be truly engaged in the recesses 35.

In conclusion, the pivot sections 13, 33 of the front sections 11, 31 are respectively formed with engaging socket 15 and recesses 35, while the rear sections 21, 41 are correspondingly disposed with projecting post 26 and engaging block 46. The lugs 23, 43 of the rear sections 21, 41 clamp two sides of the pivot sections 13, 33 of the front sections 11, 31, whereby the projecting post 26 and the engaging block 46 are respectively firmly engaged, supported and located in the engaging socket 15 and the recess 35. Therefore, when the rear sections 21, 41 are moved forward, the rear sections 21, 41 are engaged with the front sections 11, 31 and cannot be pivotally rotated. When the rear sections 21, 41 are moved backward, the front sections 11, 31 and the rear sections 21, 41 can be pivotally rotated by a certain angle for a user to hold. Therefore, the axis of the arm of the user can coincide with the rotational axis of the screwdriver without curving the wrist. Accordingly, the screwdriver can be conveniently used, while preventing the wrist from getting hurt.

The above embodiments are only used to illustrate the present invention, not intended to limit the scope thereof. Many modifications of the above embodiments can be made without departing from the spirit of the present invention.

What is claimed is:

1. A screwdriver grip comprising a longitudinally extended front section and a longitudinally extended rear section pivotally joined together by a shaft rod, said front section having a front end disposed with a tool section and a rear end formed with a pivot section, said pivot section being formed with a central slot formed therethrough, said pivot section having an outer edge portion formed with a at least one inwardly directed engaging socket, said rear end of said front section having a pair of insertion recesses respectively formed in two opposing sides thereof adjacent said pivot section and in longitudinally spaced relationship with said inwardly directed engaging socket, said rear section having a pivot cavity formed in a front end thereof for receiving said pivot section therein, said front end of said rear section having a pair of lugs respectively extending on two sides of said pivot cavity, said pair of lugs being respectively reversibly insertable into said pair of insertion recesses of said pivot section, said pair of lugs each having a shaft hole formed therethrough disposed in aligned relationship with said central slot of said pivot section, said shaft rod being passed through said shaft holes and said central slot to pivotally couple said front section to said rear section, said rear section having at least one longitudinally extended engaging block disposed in said pivot cavity in correspondence with said engaging socket, wherein said rear section is reversibly displaceable with respect to said front section between a first position, where said rear section is lockingly engaged with said front section by said lugs being respectively engaged with said insertion recesses and said engaging block is engaged with said engaging socket, to a second position where said rear section is pivotable with respect to said front section by disengagement of said lugs from said insertion recesses and disengagement of said engaging block from said engaging socket.

* * * * *